United States Patent [19]

Garner et al.

[11] 4,186,923

[45] Feb. 5, 1980

[54] CRICKET BAT

[75] Inventors: Arthur W. B. Garner, Middlefield Cottage, Great Shelford, Cambridge, England; John L. Newbery, Robertsbridge, England

[73] Assignee: Arthur Winston Buckton Garner, Great Shelford, England

[21] Appl. No.: 933,493

[22] Filed: Aug. 14, 1978

[51] Int. Cl.[2] ..... A63B 59/08

[52] U.S. Cl. ..... 273/67 D

[58] Field of Search ..... 273/67 R, 67 D, 67 DA, 273/67 DB, 67 DC

[56] References Cited

FOREIGN PATENT DOCUMENTS

| | | | |
|---|---|---|---|
| 76316 | 6/1976 | Australia | 273/67 D |
| 7710 | of 1907 | United Kingdom | 273/67 DB |
| 19668 | of 1907 | United Kingdom | 273/67 D |
| 13559 | of 1914 | United Kingdom | 273/67 DC |

*Primary Examiner*—Charles E. Phillips

*Attorney, Agent, or Firm*—Ross, Ross & Flavin

[57] ABSTRACT

For extending the sweet spot of the blade of a cricket bat, said blade has, in its rear surface, a depression or depressions so arranged and/or dimensioned and/or positioned that the thickness of the blade, at or near its sweet spot, is greater than the maximum thickness of the blade at that part of the edge or each depression which is at or is closest to the edge of the blade.

11 Claims, 15 Drawing Figures

CRICKET BAT

BACKGROUND OF THE INVENTION

This invention concerns cricket bats.

As is well known, a cricket bat traditionally comprises an elongate blade, made almost exclusively of selected willow, to one end of which a handle is spliced, the blade being shaped to provide a front striking surface and an opposed rear surface.

The invention is more particularly concerned with cricket bats of the kind wherein the rear surface of the blade is so modified or designed, in comparison with traditional bats that more of the mass of the blade is concentrated adjacent to the periphery of the blade, and/or adjacent to the toe or shoulder of the blade, while the front surface of the blade (normally used for striking the ball) is not significantly changed in comparison with the traditional designs.

The shape of the conventional cricket bat has remained standard for many years. One constant feature has been the shape of the rear surface of the blade of the bat. This has been so formed so that the maximum thickness, and hence the mass, is situated at a point approximately six inches from the lower end or toe of the blade.

The mass of the blade, and hence the thickness of the blade, gradually decreases away from the point of maximum thickness both towards the longitudinal edges and towards the shoulder (i.e. the end to which the handle connects) and the toe of the blade in such a way that the rear surface of the blade has a central ridge extending down the length of the blade and merging with the contour of the blade between the said point of maximum thickness and the toe of the blade.

This central ridge is thus situated on the plane of symmetry of the blade. A cross-section through the blade at any position along the ridge is such that the maximum thickness, and hence concentration of mass of the section, lies on the plane of symmetry of that section, while the least mass (or narrowest section) of the blade is situated adjacent to the periphery or edges of the blade.

The "sweet spot" of a cricket bat blade is familiar to persons skilled in the art of cricket as the optimum location for bat/ball contact to ensure the most effective hit in terms of distance and direction of ball travel for the work done in striking the ball. Usually, the sweet spot is a region whose center lies about 6 inches (15 cm) from the toe of the bat.

The effect of contact to either side of the sweet spot is to turn the bat on its longitudinal axis so that a misdirected and weak hit results. A strike nearer to the handle area or shoulder results in a "lifted" hit with a higher trajectory than desired, giving an increased risk of being "caught out", while a strike nearer the toe of the bat results in a lower trajectory than desired and a shorter than optimum hit.

BRIEF DETAILS OF THE PRIOR ART

In my prior British Pat. No. 1,391,120, I describe and claim a cricket bat comprising a handle to which is connected a blade shaped to provide a front striking surface and a rear surface at the side opposed to the striking surface, characterised in that the rear surface is formed with one or more depressions so disposed that the blade is of maximum thickness at or adjacent the periphery of the blade.

In comparison with the above-discussed conventional cricket bat blade design, wherein the blade is thickest along its longitudinal center line and tapers to only a minimal thickness at its longitudinal edges, the invention of my aforesaid prior patent had the effect of extending the effective size of the sweet spot by concentrating more of the mass of the blade around the periphery thereof. The purpose of this present invention is to provide a cricket bat having the advantage of an extended sweet spot, while providing increased reinforcement of the blade in the region of the sweet spot.

BRIEF DESCRIPTION OF THE PRESENT INVENTION

With this purpose in view, the present invention provides a cricket bat comprising a handle to which is connected a blade shaped to provide a front striking surface and a rear surface opposed to the striking surface, characterised in that the rear surface is formed with one or more depressions so dimensioned and/or positioned that the thickness of the blade, at or near its sweet spot, is greater than the maximum thickness of the blade at that part of the edge of the or each depression which is at or is closest to the edge of the blade.

The arrangement is preferably such that the thickness of the blade at or near the sweet spot is greater than the thickness at any other part of the blade.

BRIEF LIST OF THE DRAWINGS

The invention will be described further, by way of example, with reference to the accompanying drawings in which.

DESCRIPTION OF THE ILLUSTRATED EMBODIMENTS

Figure 1:
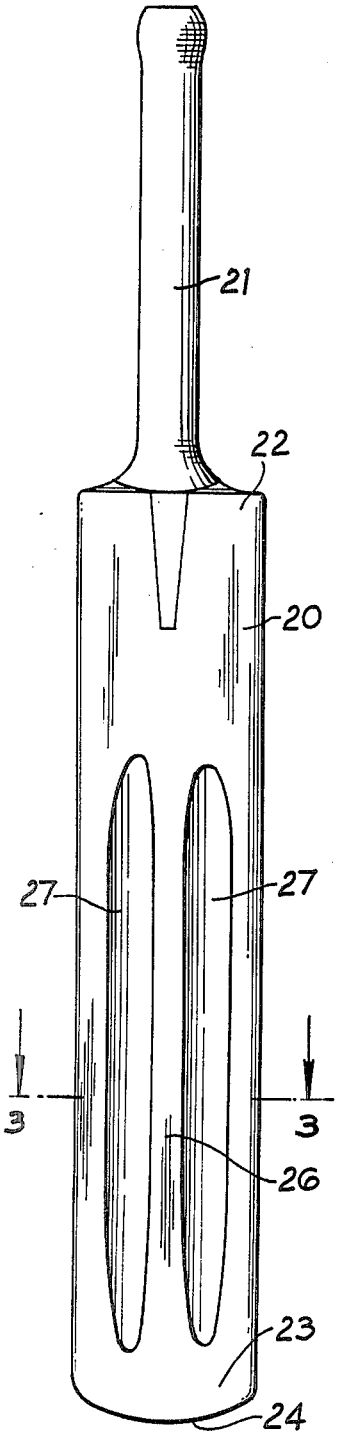
FIG. 1 is an elevation of a first embodiment of the cricket bat according to the present invention, this view showing the rear surface of the blade of the bat.

Throughout the various figures, similar parts have been allocated similar reference numerals.

Figure 2:
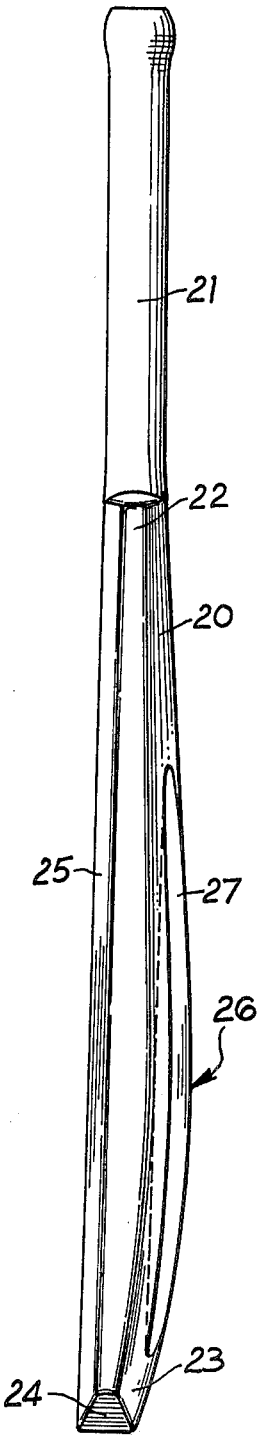
FIG. 2 is a side view corresponding to FIG. 1.
Figure 3:
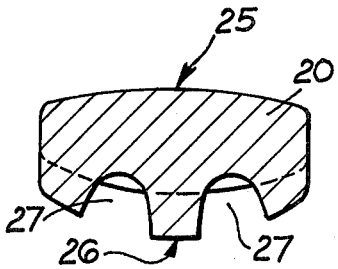
FIG. 3 is a section, to a slightly enlarged scale, through the blade of the bat of FIGS. 1 and 2, the section being taken as indicated by the line 3—3 of FIG. 1.

Referring firstly to FIGS. 1 to 3, the first illustrated embodiment of the cricket bat of the invention comprises an elongate willow blade 20 to one end 22 of which a handle 21 is spliced.

End 23 of the blade 20 remote from the handle 21 (which end is known as the toe) is rounded as at 24.

As can be seen from FIGS. 2 and 3, front face 25 (which is the striking face of the bat) of the blade 20 is very slightly curved so that the profile thereof, when considered in sectional plan as in FIG. 3, is convex. As with the traditional configuration of cricket bat blade, the blade 20 tapers longitudinally in thickness from a maximum thickness, substantially in correspondence with the sweet spot of the bat, at 26, both towards the end 22 (called the shoulder) to which the handle 21connects and towards the toe 23. Additionally, the blade 20 tapers laterally outwards from its longitudinal center line at both sides of said center line, so that the blade has the appearance of possessing a shaped ridge centrally longitudinally of the rear surface of the blade 20, the height of this ridge being at a maximum at 26 in correspondence with the sweet spot. In comparison with the traditional overall blade shape, however, the blade 20 in the illustrated case is significantly thicker at its longitudinal edge than the traditional blade shape, especially in the region of the sweet spot, as can be seen from FIGS. 2 and 3, and this contributes to enlarging the effective area of the sweet spot.

Formed in the rear face of the blade 20 are two substantially parallel depressions 27, in the form of arcuate-sectioned grooves, one at each side of the longitudinal ridge, these extending from points close to the toe 23 over about two-thirds of the length of the blade 20. It will readily be understood that these depressions extend parallel to one another along each side of the center of the sweet spot and are of a depth such that the blade thickness at the sweet spot is greater than the blade thickness at that part of the edge of each depression which is closest to the adjacent edge of the blade. This results in extension of the sweet spot while ensuring that the blade is strengthened or reinforced in the region of the sweet spot, especially as compared with the blade configuration specifically disclosed in the specification of our aforementioned prior patent.

A corresponding effect, namely extension or enlargement of the region of the sweet spot, whilst reinforcing the blade in that region, is achieved in each of the other embodiments of the bat of the invention as illustrated in FIGS. 4 to 15 of the drawings.

Figure 5:
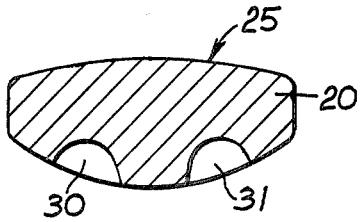
FIG. 5 is a section, to a slightly enlarged scale, through the blade of the bat of FIG. 4, the section being taken as indicated by the line 5—5 of FIG. 4.
Figure 4:
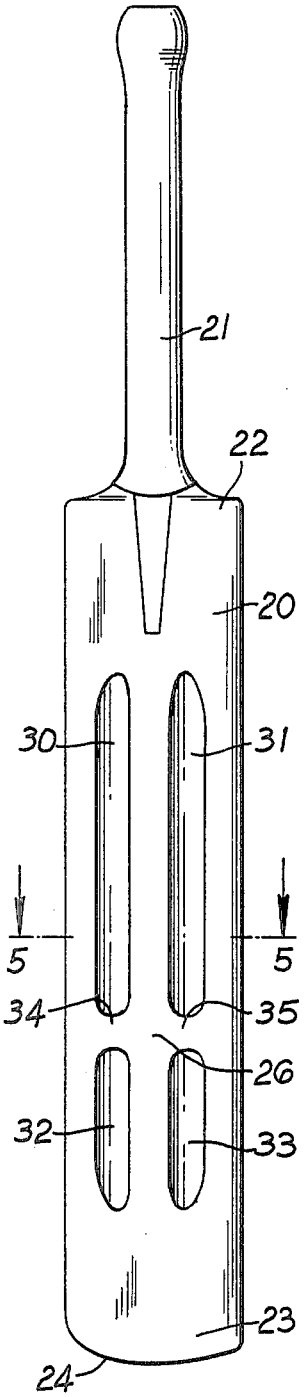
FIG. 4 is a view similar to FIG. 1, but illustrating a second embodiment of the cricket bat of the invention.

In the embodiment of FIGS. 4 and 5, there is a similar arrangement of depressions to that of FIGS. 1 to 3, but in this instance there are two pairs of depressions provided by long grooves 30 and 31 and respective aligned short grooves 32 and 33, this arrangement providing for lateral ribs 34, 35 in register with or near to the sweet spot and between the adjacent ends of the grooves 30, 32 and 31, 33 in each pair. Of course, these lateral ribs 34, 35 can be provided upwards or downwards relative to the sweet spot so as to vary the feel of the bat according to the user's requirements.

Figure 7:
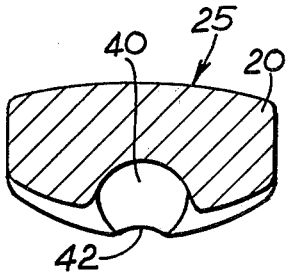
FIG. 7 is a section, to a slightly enlarged scale, through the blade of the bat of FIG. 6, the section being taken as indicated by the line 7—7 of FIG. 6.
Figure 8:
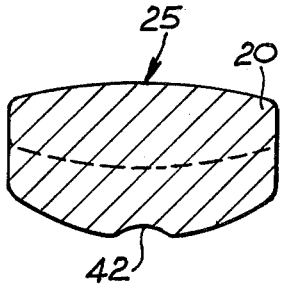
FIG. 8 is a similar section, but taken as indicated by the line 8—8 of FIG. 6.
Figure 6:
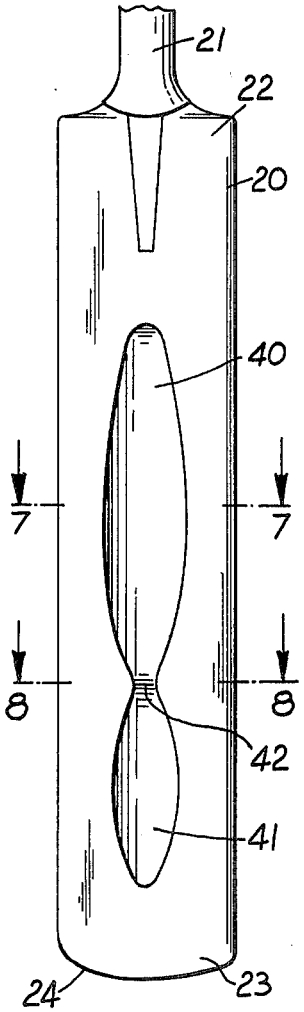
FIG. 6 is a view similar to FIGS. 1 and 4, but illustrating a third embodiment of the cricket bat of the invention.

The construction of FIGS. 6, 7 and 8 of the drawings is formed with two approximately elliptical depressions 41, 41 arranged with their major axes in alignment and substantially along the longitudinal center line of the blade, said depressions merging at their adjacent ends substantially at the sweet spot of the blade 20. From FIGS. 7 and 8 it will be appreciated that the maximum thickness of the blade is in the region of the sweet spot, whose center is approximately where indicated at 42, and that the thickness of the blade at the edges of the depressions nearest the edges of the blade is less than the thickness adjacent the sweet spot. It will readily be evident that with this embodiment one can provide for the sweet spot to have its center 42 at any desired height from the toe 23 of the blade 20 by appropriate variation of the position at which the two depressions merge, and, of course, with all the other embodiments the weight and feel of the bat can additionally be varied by variation of the lengths, widths, depths and positions of the depressions or grooves, and of course the maximum and minimum thicknesses of the material of the blade.

Figure 9:
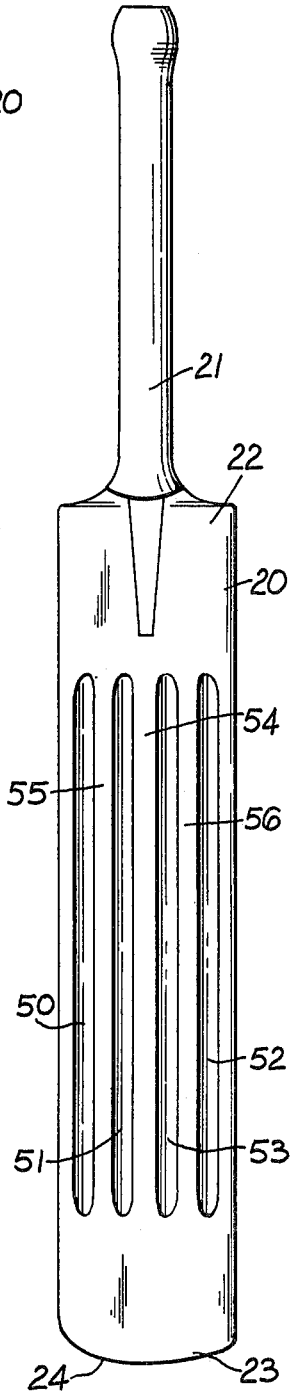
FIG. 9 is a view similar to FIGS. 1, 4 and 6, but showing a fourth embodiment of the cricket bat of the invention.

Turning now to FIG. 9 it will readily be understood that this bat is a development of that of FIGS. 1 to 3 in that it is provided with two parallel pairs of depressions in the form of grooves 50, 51 and 52, 53, with one pair at each side of the longitudinal center line of the blade 20 in the place of the individual grooves 27 in the FIGS. 1 to 3 embodiment. These four grooves 50 to 53 are, of course, relatively narrower than the grooves 27, so as to provide, in addition to a central longitudinal reinforcing rib 54 along the rear surface of the blade, two additional parallel ribs 55, 56.

Figure 10:
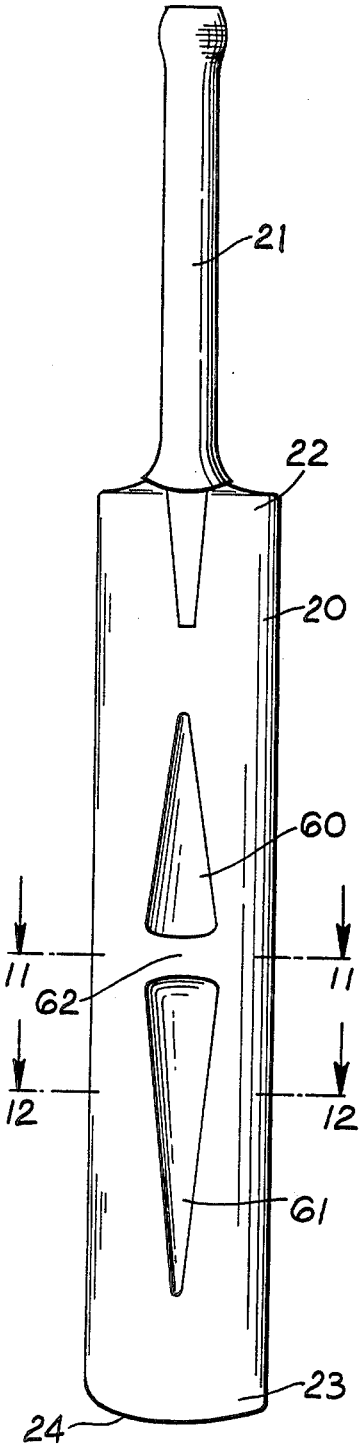
FIG. 10 is a view similar to FIGS. 1, 4, 6 and 9, but showing a fifth embodiment of the cricket bat of the invention.
Figure 11:
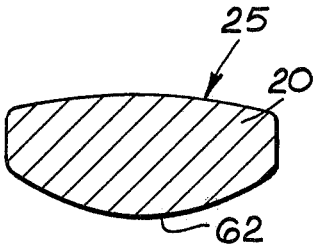
FIG. 11 is an enlarged section taken on the line 11—11 of FIG. 10.
Figure 12:
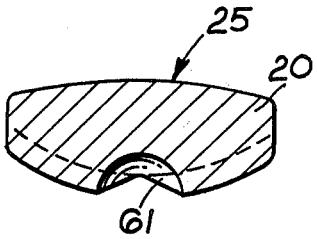
FIG. 12 is a similar section taken on the line 12—12 of FIG. 10.

The bat of FIGS. 10 to 12 is comparable with that of FIGS. 6 to 8 in that it has two depressions 60, 61 in the rear surface of its blade 20, which depressions are generally in alignment with one another along the longitudinal center line of the blade. In this case, however, the depressions are approximately triangular in configuration and are in a mirror image arrangement with the bases of the triangles adjacent but spaced apart somewhat from each other. Accordingly the depressions define between them a transverse reinforcement rib 62 in register with the thickest part of the bat and in correspondence with the region of the sweet spot of the blade. In the illustrated case, the sweet spot is somewhat higher up the blade 20 than in the case of the bats of the previous embodiments, but it will readily be understood that the proportions of the triangular depressions and spacing and positions thereof can be varied to provide for the sweet spot and feel of the bat to be as required by the user.

Figure 13:
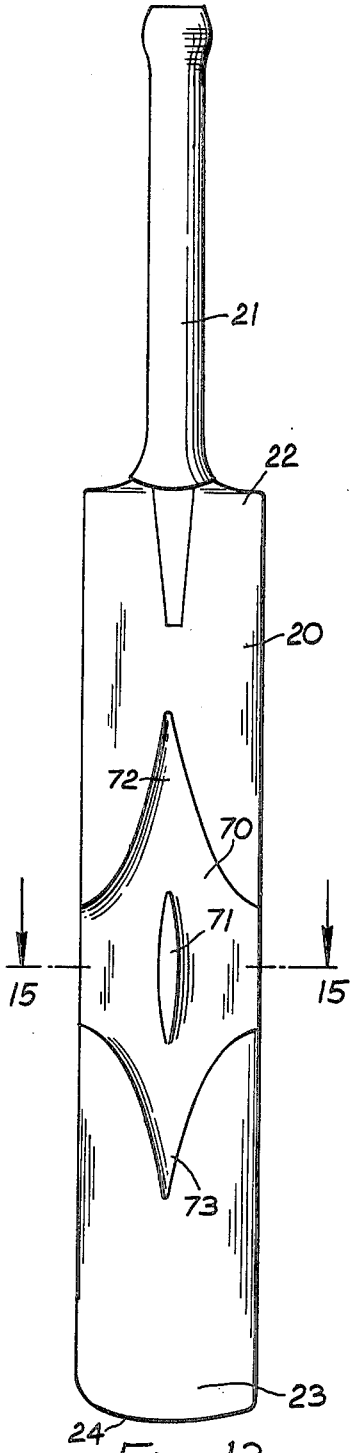
FIG. 13 is a view similar to FIGS. 1, 4, 6, 9 and 10, but showing a sixth embodiment of the cricket bat of the invention.
Figure 14:
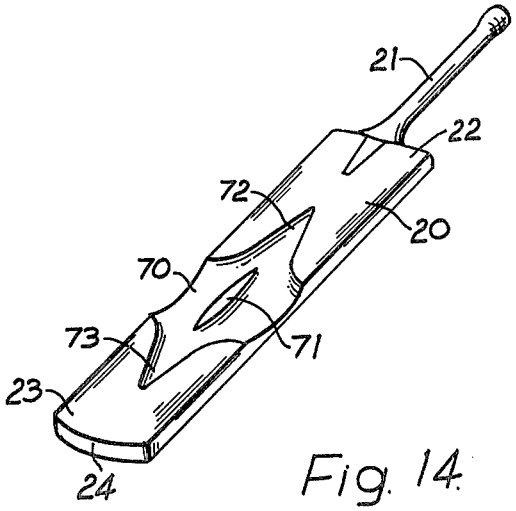
FIG. 14 is a perspective view, to a reduced scale, of the bat of FIG. 13.
Figure 15:
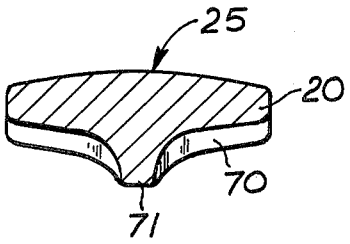
FIG. 15 is an enlarged section taken on the line 15—15 of FIG. 13.

Finally, the bat of FIGS. 13 to 15 is shaped to have a single depression 70 formed by carving out the material of the blade 20 in the rear surface thereof so as to produce, around a short reinforcing rib 71 extending along the longitudinal centre line of the blade, a six-sided figure which opens to the edges of the blade and has two oppositely-directed V-shaped recesses 72 and 73 extending respectively towards the shoulder 22 and toe 23 of the blade 20. In the illustrated case, the length of the rib 71 is just slightly longer than the open edges of the depression 70 at the edges of the blade, but of course the rib 71 can be longer or shorter, as may be desired. Again, in this case, the position of the depression 70 and rib 71, and the dimensions thereof, can be varied from what has been shown, so as to vary the position of the sweet spot and the feel of the bat.

The invention is not confined to the precise details of the foregoing examples which may be varied within the scope of the following claims.

We claim:

1. A cricket bat comprising an elongated handle connected to an elongated blade along the longitudinal axes of said blade and handle to form a continuous elongated implement, said blade shaped to provide a front striking surface and a rear surface at the side opposed to the striking surface, characterised in that said rear surface is formed with at least one depression so configured that the thickness of said blade, in the region of its sweet spot, is greater than the maximum thickness of said blade at that part of the depression edge which is closest to the edge of said blade.

2. A cricket bat as set forth in claim 1 characterised in that the thickness of said blade in the region of said sweet spot is greater than the thickness at any other part of the blade.

3. A cricket bat as claimed in claim 2 characterised in that it comprises depressions in the form of two pairs of substantially parallel grooves, with one pair disposed at each side of and substantially parallel to the longitudinal center line of said blade.

4. A cricket bat as set forth in claim 1 characterised in that it has two said depressions.

5. A cricket bat as set forth in claim 4, characterised in that said depressions are a pair of substantially parallel grooves disposed one at each side of the longitudinal center line of said blade.

6. A cricket bat as set forth in claim 4, characterised in that said depressions are aligned on the longitudinal center line of said blade.

7. A cricket bat as set forth in claim 6, characterised in that said depressions are of elliptical configuration with their major axis substantially along the said longitudinal center line.

8. A cricket bat as set forth in claim 7, characterised in that the adjacent ends of said depressions merge substantially in register with the region of said sweet spot.

9. A cricket bat as set forth in claim 6 wherein said depressions are of substantially triangular configuration, arranged with their bases adjacent and substantially in a mirror-image disposition substantially along the longitudinal center line of said blade.

10. A cricket bat as set forth in claim 1, characterised in that it comprises a single depression around a rib along the longitudinal center line of said blade, said depression breaking to the edges of said blade.

11. A cricket bat as claimed in claim 10, wherein said depression is shaped to provide oppositely-directed V-shaped recesses directed respectively towards the shoulder and the toe of said blade.

* * * * *